US005308073A

United States Patent [19]

McKoon et al.

[11] Patent Number: 5,308,073

[45] Date of Patent: May 3, 1994

[54] GOLF PUTTER

[76] Inventors: Carl T. McKoon, 1501 Knightsbridge Ct., Winston-Salem, N.C. 27127; Michael T. McKoon, 845 Apt. E, Stadium Dr., Wake Forest, N.C. 27587

[21] Appl. No.: 78,649

[22] Filed: Jun. 21, 1993

[51] Int. Cl.[5] ..... A63B 69/36; A63B 53/02; A63B 53/14

[52] U.S. Cl. ..... 273/187.4; 273/80 C; 273/81 R; 273/163 A; 273/77 R; 273/164.1; 273/81.3

[58] Field of Search ..... 273/164.1, 80 C, 163 R, 273/163 A, 164.1, 81 R, 77 R, 187.5, 187.4, 193 R, 194, 81.3

[56] References Cited

U.S. PATENT DOCUMENTS 3,191,936 6/1965 Guier ..... 273/164.1 X
4,795,153 1/1989 Thomas ..... 273/80 C X

*Primary Examiner*—George J. Marlo

[57] ABSTRACT

A golf putter which includes a putter head and substantially parallel shafts extending from the putter head, the shafts having gripping sections adapted to be gripped by the golfers hands to move the golf putter. The shafts are bent proximate the putter head and join the putter head in a plane substantially parallel with the longitudinal axis of the elongated body of the putter head.

5 Claims, 1 Drawing Sheet

GOLF PUTTER

BACKGROUND OF THE INVENTION

1. Field of the Invention

The present invention relates to a novel golf putter and, more particularly, to a dual shafted golf club putter for permitting greater control of the path of movement of the club.

2. Description of the Prior Art

Golf is one of the most demanding and perplexing sports in that it requires extreme accuracy and in-depth concentration. The necessary accuracy can be developed by constant improvement in the techniques for holding and stroking the golf clubs including addressing and stroking the ball. Each of these steps is absolutely essential to the end result of moving the ball on a desired projectory with a high degree of accuracy and consistency.

The most critical part of the game of golf is putting which takes place after the ball is positioned on the green.

When using a golf putter, especially for putting, the players hands normally grip along the same area, since there is a single shaft having a handle. This requires the player to place one hand above the other, a grip that is unnatural. Because of the unnatural placement of hands, there is an increased tendency to turn the club along its axis by rolling or breaking the wrists. This tendency is especially detrimental for putting. A proper putting stroke involves using the shoulders and upper body, without the wrists affecting the stroke.

In order to avoid the unnatural hand placement commonly occurring when using conventional golf clubs, it has been suggested to use a parallel pair of widely spaced handles. See for example, U.S. Pat. No. 1,919,221. Because of this wide spacing, rotating with this putter is not similar to that occurring when the player uses a single handle putter. The large handle-to-handle spacing of the prior putter has a feel which is different from the single handle putter.

In addition, the golfer does not recognize the importance of training with a dual handed putter for putting. Training for putting requires a proper feel to accomplish a polished putting stroke. Also with putting, the alignment between handle and the face of the putter head is important. The prior art has neither taught the use of a dual-handled putter nor taught the proper alignment that should be utilized with a dual-handled putter.

Accordingly, there is a need for an improved golf putter having a handle system which allows the hands, arms and shoulders to follow the putting stroke path and thereby keep the face of the putter head perpendicular to the path of travel of the ball once it is stroked. The present invention is directed to that need.

SUMMARY OF THE INVENTION

The present invention provides an improved golf putter particularly used for putting which has a putter head with an elongated body, a heel portion, a toe portion and a striking face for striking the golf ball. Two substantially parallel shafts extend from the putter head and have gripping areas adapted to be gripped by the golfer's hands to move the golf club. A connector joins the gripping areas preferably at the upper end of the substantially parallel shafts, and each of the parallel shafts has a bent section near the point where the shafts join the putter head. The parallel shafts join the elongated body of the putter head in a plane substantially parallel with the longitudinal axis of the elongated body of the putter head.

Thus the present invention enables the control movement of the hands, arms and shoulders of the golfer to move the putter in a substantially straight line which is essential to mastering the skills of putting. With this device, the rather difficult use of a single handled putter is simplified and more consistent putting results.

It is, therefore, an object of the present invention to provide a novel golf putter of the type described that has all of the advantages of prior art clubs and none of the disadvantages and which is used to ensure the proper stroke path necessary for good putting.

A further object of the present invention is to provide a novel golf putter having substantially parallel shafts that can connect directly to the putter head.

A further object of the present invention is to provide a novel golf putter for increasing the control and stability in the gripping of a golf putter particularly during putting.

Yet still another further object of the present invention is to provide a novel golf putter which eliminates the strained position that the hands are in when using a single shafted golf putter with a conventional overlapping grip.

Still other objects, features and attendant advantages of the present invention will become apparent to those skilled in the art after a review of the following detailed description taken in conjunction with the accompanying drawings wherein like characters of reference designate like parts throughout the several views.

DESCRIPTION OF THE PREFERRED EMBODIMENT

Figure 1:
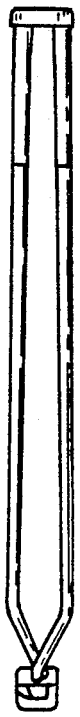
FIG. 1 is a front elevational view of a golf putter comprising the present invention.
Figure 2:
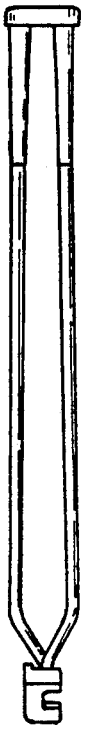
FIG. 2 is a rear elevational view of the golf putter shown in FIG. 1.
Figure 3:
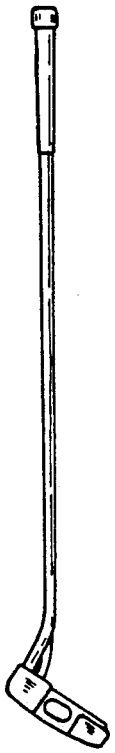
FIG. 3 and FIG. 4 are elevational views of the other sides of the golf putter shown in FIGS. 1 and 2.
Figure 4:
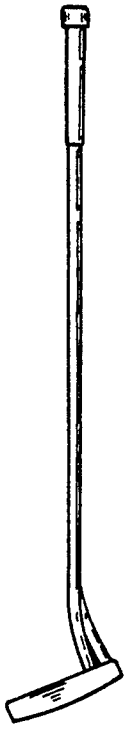
Figure 5:
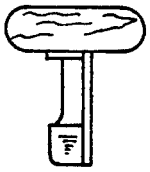
FIG. 5 is a plane view of the golf putter shown in FIGS. 1, 2, 3 and 4.
Figure 6:
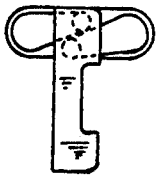
FIG. 6 is a bottom view of the golf putter shown in FIGS. 1, 2, 3, 4 and 5.
Figure 7:
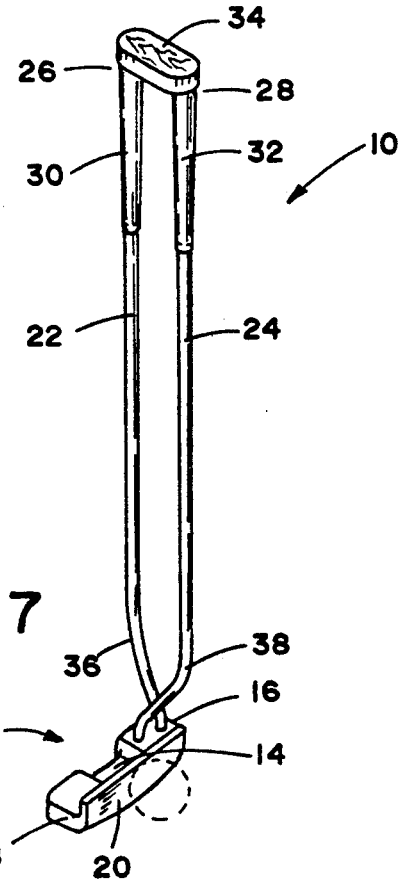
FIG. 7 is a perspective view of the golf putter shown in FIGS. 1–6.

Referring now to the drawings, there is shown generally as 10 in FIG. 7, the golf putter comprising the present invention having a putter head shown generally as 12 with an elongated body 14, a heel portion 16 and a toe portion 18. A striking face 20 is formed on the elongated body 14 which is the surface that strikes the golf ball when the putter is used.

Substantially parallel shafts 22, 24 extend from putter head 12 to terminal ends 26, 28. Gripping areas 30, 32 are formed on the shafts and are adapted to be gripped by the golfers hands to move the putter as desired. A connector 34 joins the parallel shafts for stability.

Each of shafts 22, 24 have bent portions 36, 38 near putter head 12 and proximate thereto join putter head elongated body 14 near heel portion 16 in the manner shown. The junction of shafts 22, 24 with elongated body 14 is in a plane that is parallel to the longitudinal axis of elongated body 14.

Note that shaft 24 which extends upwardly from putter head 12 and is to the left of the elongated body longitudinal axis joins putter head 12 at a point nearer the putter head toe portion 18 then at the point where parallel shaft 22 joins putter head 12.

The putter comprising the present invention in commercial form is constructed with True Temper pencil shafts which deliver a sensitive feel. They are connected at the top with a decorative wood, stabilizing bar that provides a dampening affect for the dual shafts. The hozel-less design centers all of the club's weight directly on the putter head to stabilize the putting stroke and to help compensate for any off-center connections. The putting head preferably has a finish that eliminates glare and is often made of stainless steel. This hard putting surface provides for consistent striking as well as protection from wear as a result of constant use.

While the invention has been described with respect to a preferred physical embodiment constructed in accordance therewith, it will be apparent to those skilled in the art that there is modifications and improvements may be made without departing from the scope and spirit of the invention. It is therefore to be understood that within the scope of the appended claims, the invention may be practiced otherwise as specifically described.

What is claimed is:

1. A golf putter comprising: a putter head having an elongated body with a striking side and a back side, a heel portion, a toe portion, and a putting face for striking a golf ball; substantially parallel shafts extending from the putter head each having a gripping section adapted to be gripped by one of the golfer's hands to move the golf putter; and a connector joining the gripping sections, each of the parallel shafts having a straight portion and a bent portion proximate to the putter head, the parallel shafts joining the putter head elongated body in a plane parallel with the longitudinal axis of the elongated body, one shaft having the bent portion extending from the elongated body and away from the striking side and the other shaft having the bent portion extending from the body and away from the back side.

2. The putter as claimed in claim 1 wherein the parallel shafts join the putter head elongated body near the heel portion.

3. The putter as claimed in claim 2 wherein the parallel shaft extending upwardly from the putter head and away from the body striking side joins the putter head at a point forwardly and nearer the putter head toe portion than the point where the other parallel shaft joins the putter head.

4. The putter as claimed in claim 3 wherein the connector joining the parallel shafts has a longitudinal axis perpendicular to longitudinal axis of the elongated body.

5. The club as claimed in claim 1 wherein the parallel shaft extending upwardly from the putter head and away from the body striking side joins the putter head at a point forwardly and nearer the putter head toe portion than the point wherein the other parallel shaft joins the putter head.

* * * * *